US008424423B2

(12) United States Patent
Su

(10) Patent No.: US 8,424,423 B2
(45) Date of Patent: Apr. 23, 2013

(54) CONNECTING ROD ASSEMBLY

(76) Inventor: Cheng-Wei Su, Taichung (TW)

( * ) Notice: Subject to any disclaimer, the term of this patent is extended or adjusted under 35 U.S.C. 154(b) by 258 days.

(21) Appl. No.: 12/875,340

(22) Filed: Sep. 3, 2010

(65) Prior Publication Data

US 2011/0056339 A1 Mar. 10, 2011

(30) Foreign Application Priority Data

Sep. 7, 2009 (TW) ..... 98130095 A

(51) Int. Cl.
*B25B 23/16* (2006.01)
*B25G 3/18* (2006.01)

(52) U.S. Cl.
USPC ..... 81/177.85; 403/322.2

(58) Field of Classification Search ..... 81/177.85; 403/322.2
See application file for complete search history.

(56) References Cited

U.S. PATENT DOCUMENTS 6,874,392 B1 4/2005 Wu
7,121,951 B2 * 10/2006 Chang ..... 464/139
7,278,342 B1 * 10/2007 Chang ..... 81/177.75
8,070,377 B2 12/2011 Wang
2005/0145078 A1 * 7/2005 Chuan ..... 81/177.85
2009/0226248 A1 * 9/2009 Wang ..... 403/322.2
2010/0054854 A1 * 3/2010 Wang ..... 403/322.2

FOREIGN PATENT DOCUMENTS

TW 389152 U 5/2000
TW M264052 U 5/2005
TW M313574 U 6/2007

* cited by examiner

*Primary Examiner* — David B Thomas
(74) *Attorney, Agent, or Firm* — Rosenberg, Klein & Lee

(57) ABSTRACT

A connecting rod assembly comprises a connecting element, a pivot element, a connecting rod, a spring and an engaging element. The connecting element is provided at both ends thereof with a connecting portion and a driving portion. The pivot element is provided at a first end thereof with a connecting pillar formed with a pivot hole, and the connecting pillar is further formed in an outer surface thereof with a moving hole in communication with the pivot hole. The connecting rod has a first end thereof connected to the connecting element, and a second end of the connecting rod is pivotally disposed in the pivot hole. The connecting rod is formed with an evasion groove for cooperating with the engaging element. The spring is disposed in the driving groove with both ends thereof pushed against an inner surface of the driving groove and the connecting element.

5 Claims, 8 Drawing Sheets

CONNECTING ROD ASSEMBLY

BACKGROUND OF THE INVENTION

1. Field of the Invention

The present invention relates to a connecting element; and more particularly to a connecting rod assembly.

2. Description of the Prior Art

Referring to FIGS. 6-7, a conventional connecting rod D with a sleeve locking structure comprises a connecting element 60 having a first end thereof formed with a connecting groove 601. A second end of the connecting element 60 is formed with an elongated limiting groove 602. A pivot element 61 has a first end formed with a pivot groove 611, and a second end of the pivot element 61 is provided with a connecting pillar 612. The pivot element 61 is further formed in an outer surface thereof with a pin hole 613. A pivot hole 614 is formed through the connecting pillar 612 and the pivot groove 611, and a moving hole 615 in communication with the pivot hole 614 is formed in an outer surface of the connecting pillar 612. The second end of the connecting element 60 is disposed in the pivot groove 611, and a fixing pin 62 is inserted through the pin hole 613 and into the limiting groove 602. One end of the push rod 63 is formed with an engaging hole 631, and after being assembled with the spring 64, the push rod 63 will be pivotally disposed in the pivot hole 614 through the pivot groove 611. An engaging element 65 is disposed in the moving hole 615.

To use the connecting rod D, a tool head B can be pushed onto the connecting pillar 612, as shown in FIGS. 7-8, meanwhile, the pivot element 61 is pushed toward the connecting element 60 while the push rod 63 is moved toward the connecting pillar 612 to make the engaging element 65 fall into the engaging hole 631 below the surface of the connecting pillar 612, enabling the tool head B to be stably assembled onto the connecting pillar 612. When no pushing force is applied to the tool head B, the push rod 63 will be pushed by the spring 64 back to its original position, and the engaging element 65 will be pushed back onto the surface of the connecting pillar 612 so as to engage with the tool head B.

The above conventional structure suffers from the following drawbacks in practice:

1. The connecting element 60 is combined onto the pivot element 61 by inserting the fixing pin 62 into the elongated limiting groove 602, and the connecting element 60 can rotate freely around the fixing pin 62 through the elongated limiting groove 602, therefore, it can be found that such a connection manner is loose and cannot realize the assured fixing objective and will cause impact noise in use.

2. Besides the connecting element 60, the pivot element 61, the push rod 63, the spring 64 and the engaging element 65, the connecting rod D must be additionally provided with the fixing pin 62 for limiting the connecting element 60 and the pivot element 61, therefore, the structure is complicated, and after the engagement of the connecting element 60 and the pivot element 61, the fixing pin 62 must be inserted into the limiting groove 602 through the pin hole 613, so that it can be found that such an assembling process need add the steps of alignment and trying error, increasing the difficulty in assembly.

The present invention has arisen to mitigate and/or obviate the afore-described disadvantages.

SUMMARY OF THE INVENTION

Technical Problems to be Solved:

As for the conventional rod, the connection between the connecting element and the pivot element is loose and cannot realize the assured fixing objective, so that impact noise will be produced in use, and furthermore, the arrangement of the fixing pin makes not only the structure complicated but the assembly difficult.

To solve the above technical problems, a connecting rod assembly in accordance with the present invention comprises a connecting element, a pivot element, a connecting rod, a spring and an engaging element. The connecting element is provided with a connecting portion at a first end thereof and a driving portion at a second end thereof, the driving portion is a polygonal column. The pivot element is provided at a first end thereof with a connecting pillar which is a polygonal column formed with a pivot hole, a second end of the pivot element is formed with a driving groove in communication with the pivot hole, and the driving groove is structured into a polygonal hole for cooperating with the driving portion of the connecting element. The connecting pillar is formed in an outer surface thereof with a moving hole in communication with the pivot hole, and the pivot element is engaged onto the driving portion of the connecting element through the driving groove. The connecting rod has a first end thereof fixedly connected to the connecting element, and a second end of the connecting rod is pivotally disposed in the pivot hole. The connecting rod is formed in an outer surface thereof with an evasion groove, and the evasion groove is interiorly formed with an evasion portion. The spring is disposed in the driving groove with both ends thereof pushed against an inner surface of the driving groove and the connecting element. The engaging element is disposed in the moving hole and located between the moving hole and the evasion groove.

The connecting rod assembly in accordance with the present invention has the following advantages:

The primary objective of the present invention is to provide a connecting rod assembly which only comprises a connecting element, a pivot element, a connecting rod, a spring and an engaging element, since it has few components, the machining and purchase cost can be reduced, and since the respective components are combined in a simple manner, it is convenient and quick to assemble the connecting rod assembly of the present invention.

The secondary objective of the present invention is to provide a connecting rod assembly which prevents the loose connection and the impact noise while makes the operation convenient since the connecting element and the connecting rod are fixedly combined while the connecting element and the pivot element are pivotally connected and elastically pushed by the spring to ensure a stable positioning.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
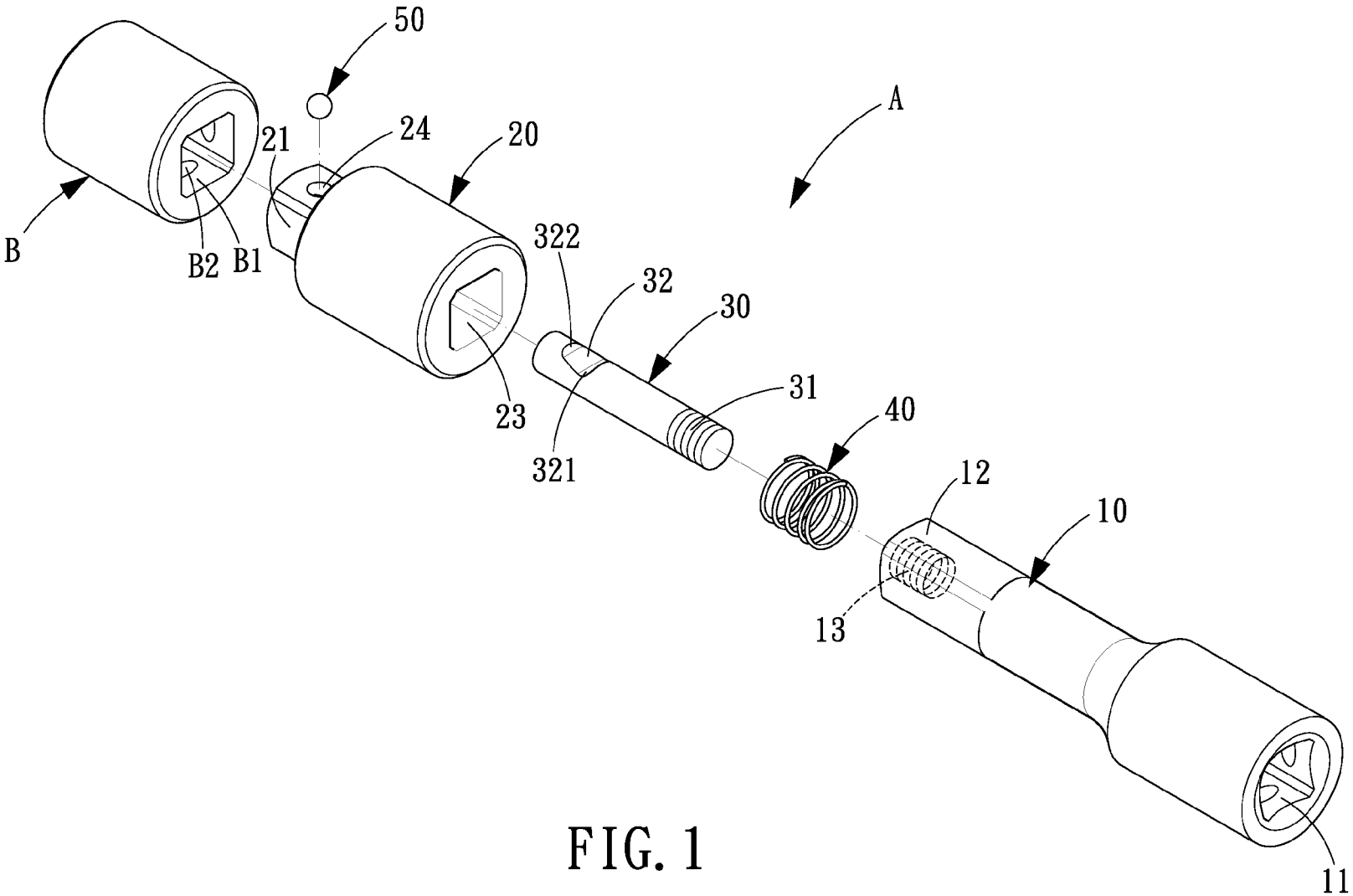
FIG. 1 is an exploded view of a connecting rod assembly in accordance with the present invention.
Figure 2:
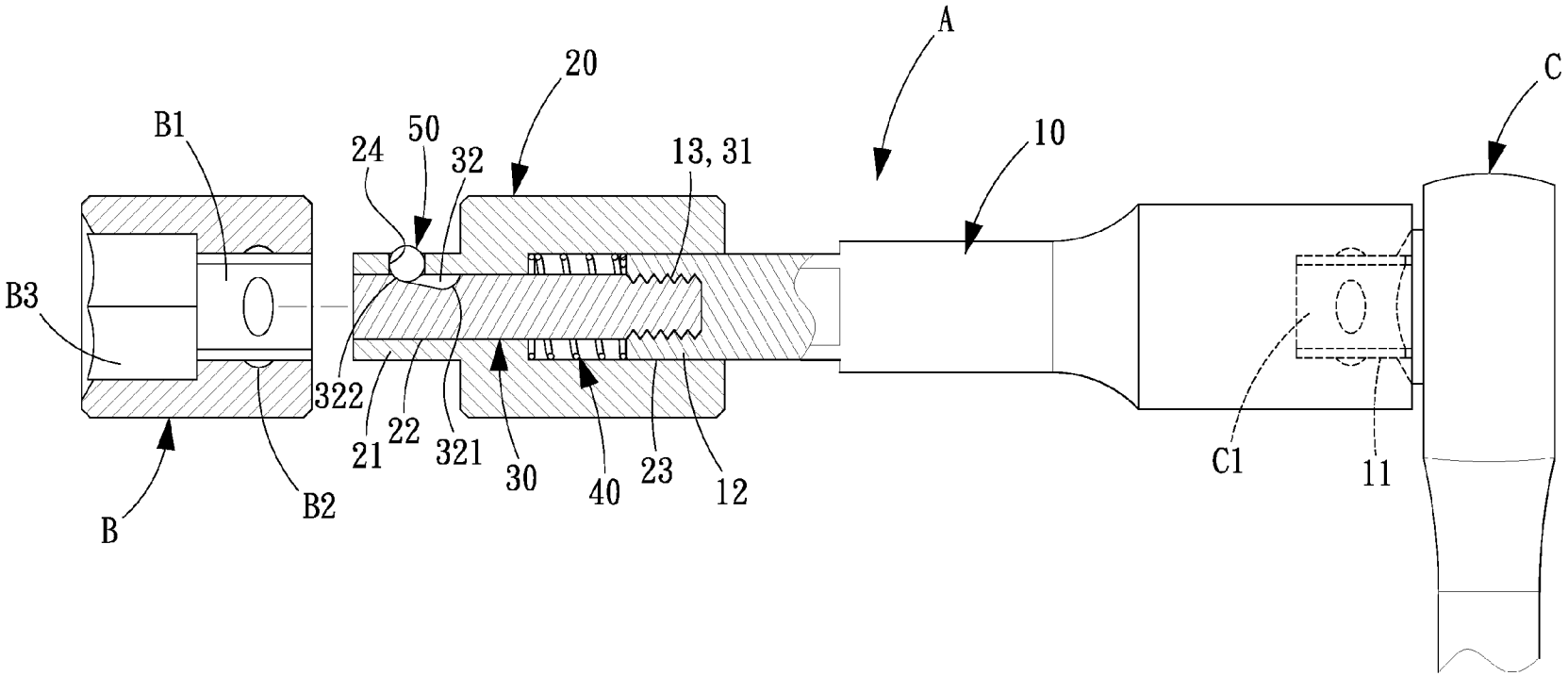
FIG. 2 is a cross-sectional view of the connecting rod assembly in accordance with the present invention.

Referring to FIGS. 1 and 2 first, a connecting rod assembly A in accordance with the present invention is used for connecting a tool head B to a rotating tool C and comprises a connecting element 10, a pivot element 20, a connecting rod 30, a spring 40, and an engaging element 50.

The connecting element 10 is provided with a connecting portion 11 at a first end thereof and a driving portion 12 at a second end thereof. The connecting portion 11 is a polygonal hole, and the driving portion 12 is a polygonal column and formed with a threaded hole 13.

The pivot element 20 is provided at a first end thereof with a connecting pillar 21 which is a polygonal column formed with a pivot hole 22. A second end of the pivot element 20 is formed with a driving groove 23 in communication with the pivot hole 22. The driving groove 23 is structured into a polygonal hole for cooperating with the driving portion 12. The connecting pillar 21 is formed in an outer surface thereof with a moving hole 24 in communication with the pivot hole 22. The pivot element 20 is engaged onto the driving portion 12 of the connecting element 10 through the driving groove 23. The engaging element 50 is in the form of ball and slidably disposed in the moving hole 24 in such a manner that it is only allowed to slide toward the pivot hole 22 and partially protrude from the surface of the connecting pillar 21 without disengagement from the moving hole 24.

The connecting rod 30 is formed on a first end thereof with a threaded portion 31 to be screwed into the threaded hole 13 for fixedly connecting the connecting rod 30 and the connecting element 10, and a second end of the connecting rod 30 is pivotally disposed in the pivot hole 22. The connecting rod 30 is formed in an outer surface thereof with an evasion groove 32. The evasion groove 32 is interiorly formed with an evasion portion 321 and a stopping portion 322. The evasion portion 321 is deeper than the stopping portion 322. The evasion portion 321 is located adjacent to the first end of the connecting rod 30 while the stopping portion 322 is located adjacent to the second end of the connecting rod 30.

The spring 40 is disposed in the driving groove 23 with both ends thereof pushed against an inner surface of the driving groove 23 and the connecting element 10.

The engaging element 50 is disposed in the moving hole 24 and located between the moving hole 24 and the evasion groove 32.

The tool head B is formed in a first end thereof with a combining hole B1 which is polygonal in cross section. The combining hole B1 is formed in an inner surface thereof with at least one engaging groove B2 for engaging with the engaging element 50. A second end of the tool head B is provided with a tool portion B3. The combining hole B1 of the tool head B is engaged with the connecting pillar 21. The engaging element 50 falls into the evasion portion 321 and is brought into alignment with the engaging groove B2 at the same time, as shown in FIG. 3.

The rotating tool C is provided with a combining portion C1 in the form of a polygonal column. The connecting portion 11 is engaged on the combining portion C1 to connect the connecting rod assembly A and the rotating tool C together.

The connecting rod assembly A is normally assembled in such a manner that the connecting element 10 is fixed on the connecting rod 30, and the pivot element 20 on the connecting element 10 is elastically pushed by the spring 40 to keep the engaging element 50 protruding from the surface of the connecting pillar 21.

Figure 3:
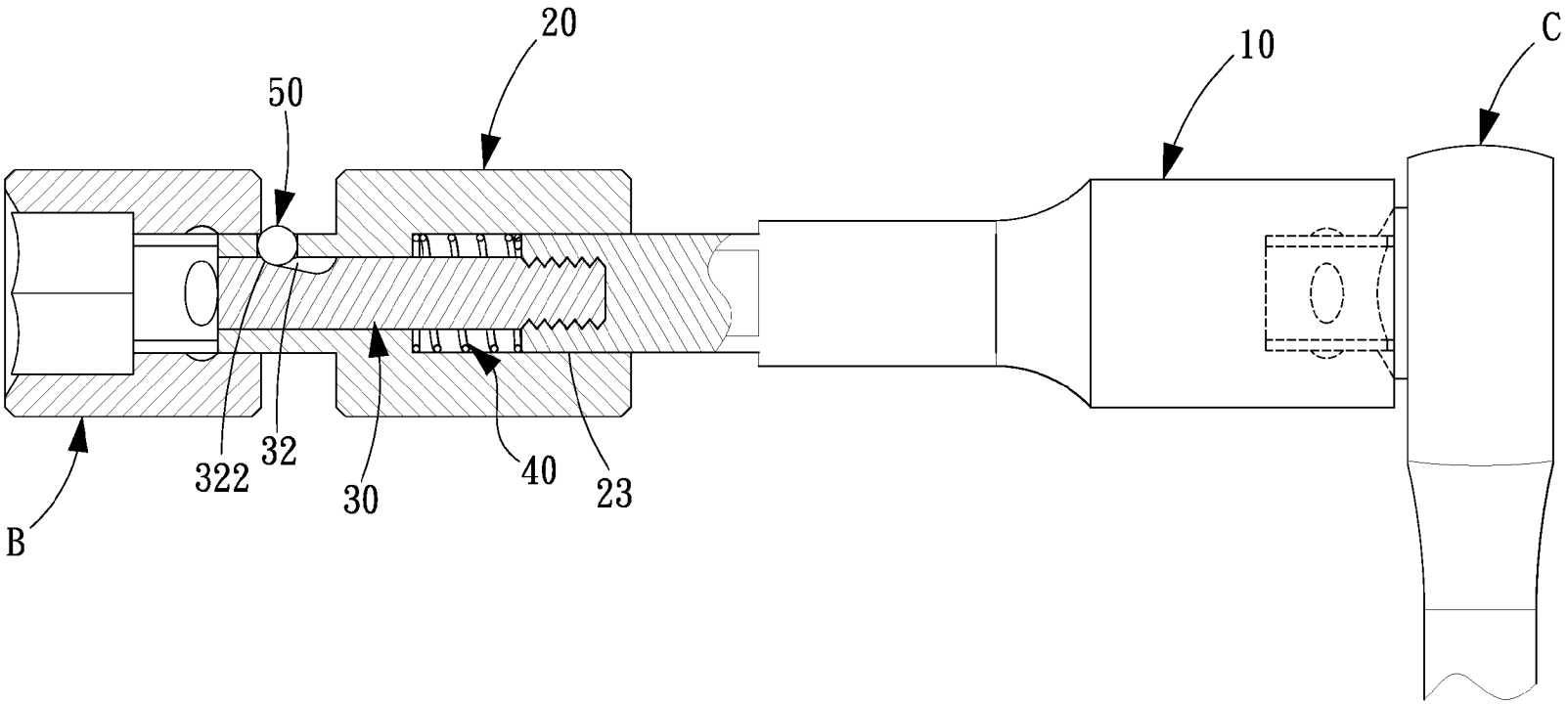
FIG. 3 is a cross-sectional view showing the connecting rod assembly is ready for engaging with a tool head.
Figure 4:
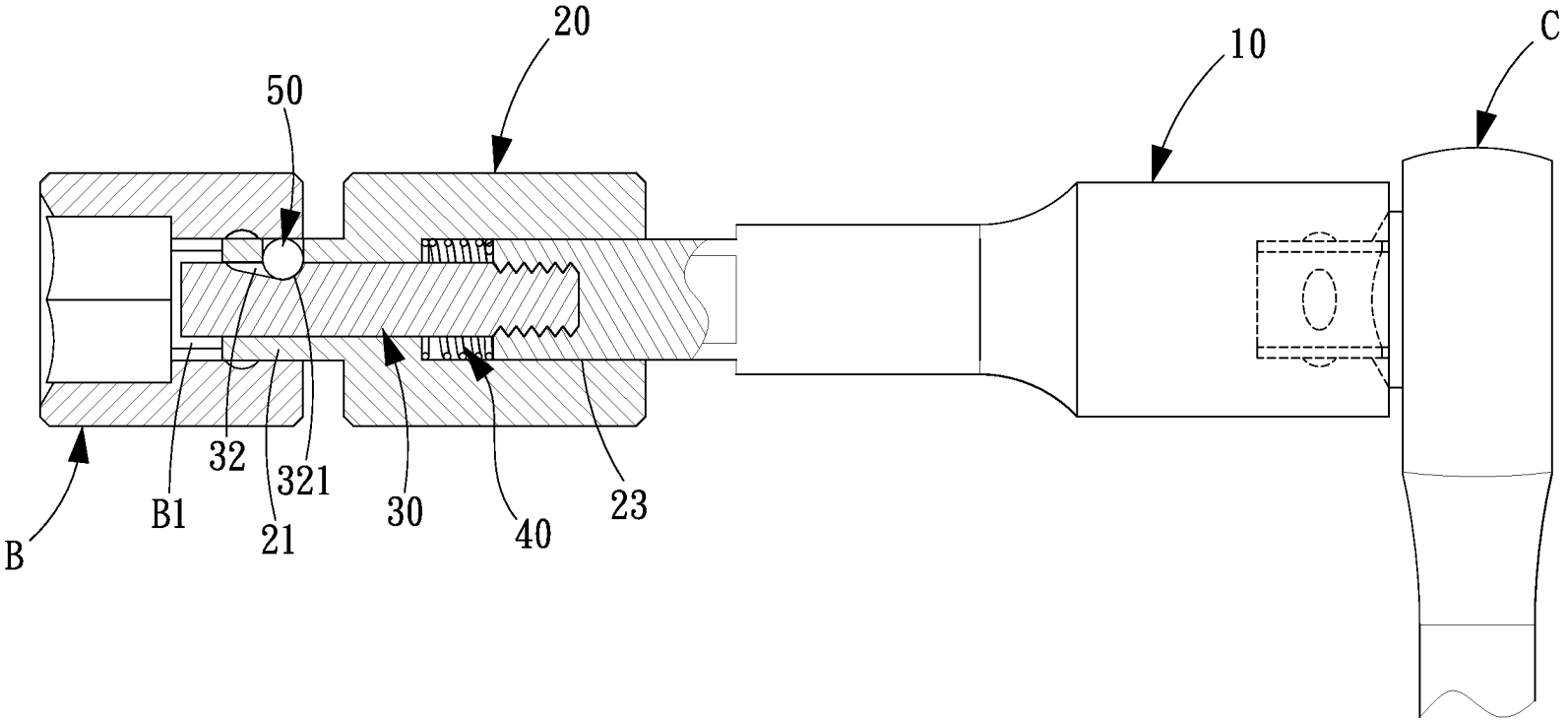
FIG. 4 is a cross-sectional view showing the connecting rod assembly in accordance with the present invention is engaging with the tool head.
Figure 5:
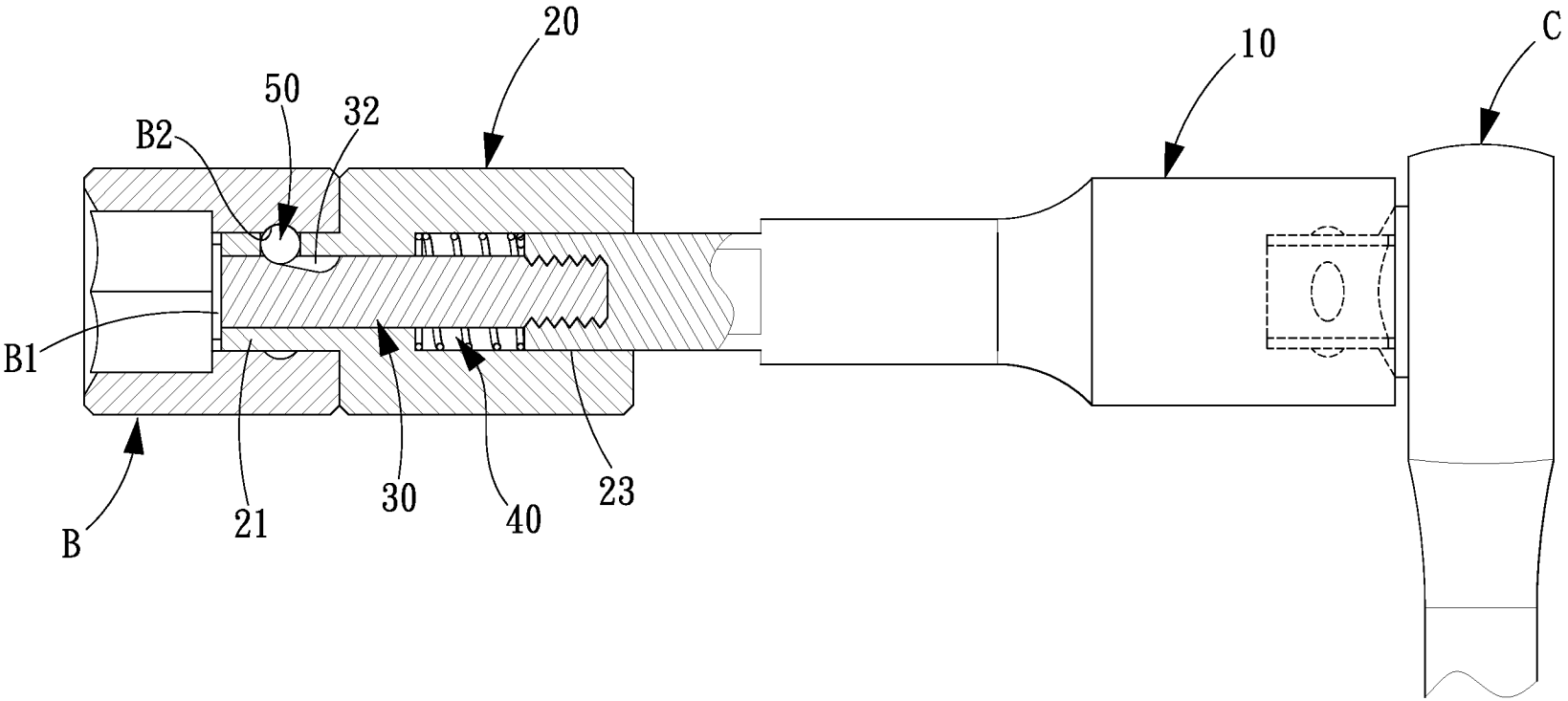
FIG. 5 is a cross-sectional view showing that the connecting rod assembly in accordance with the present invention finishes engaging with the tool head.
Figure 6:
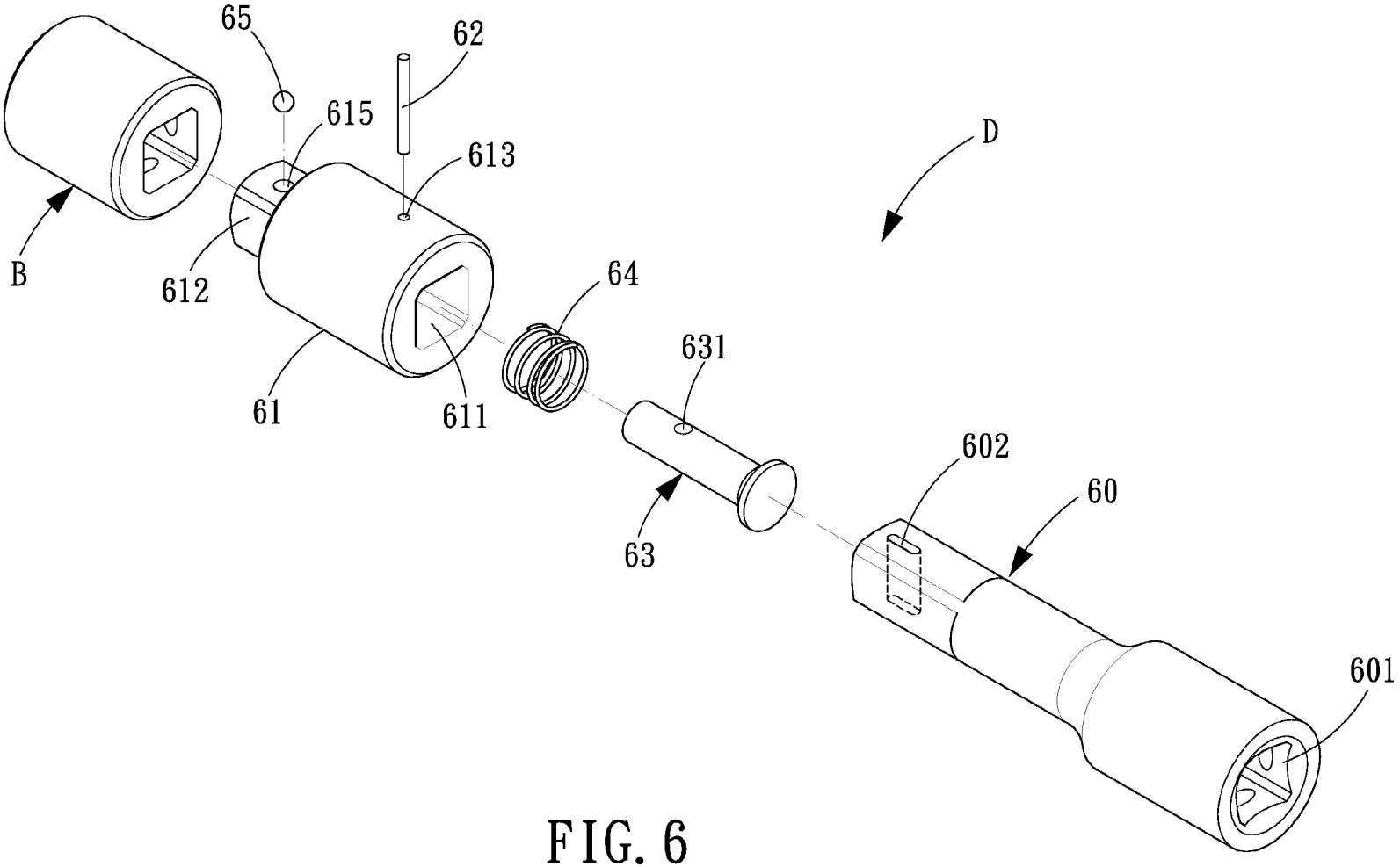
FIG. 6 PRIOR ART
FIG. 6 is an exploded view of a conventional connecting rod.
Figure 7:
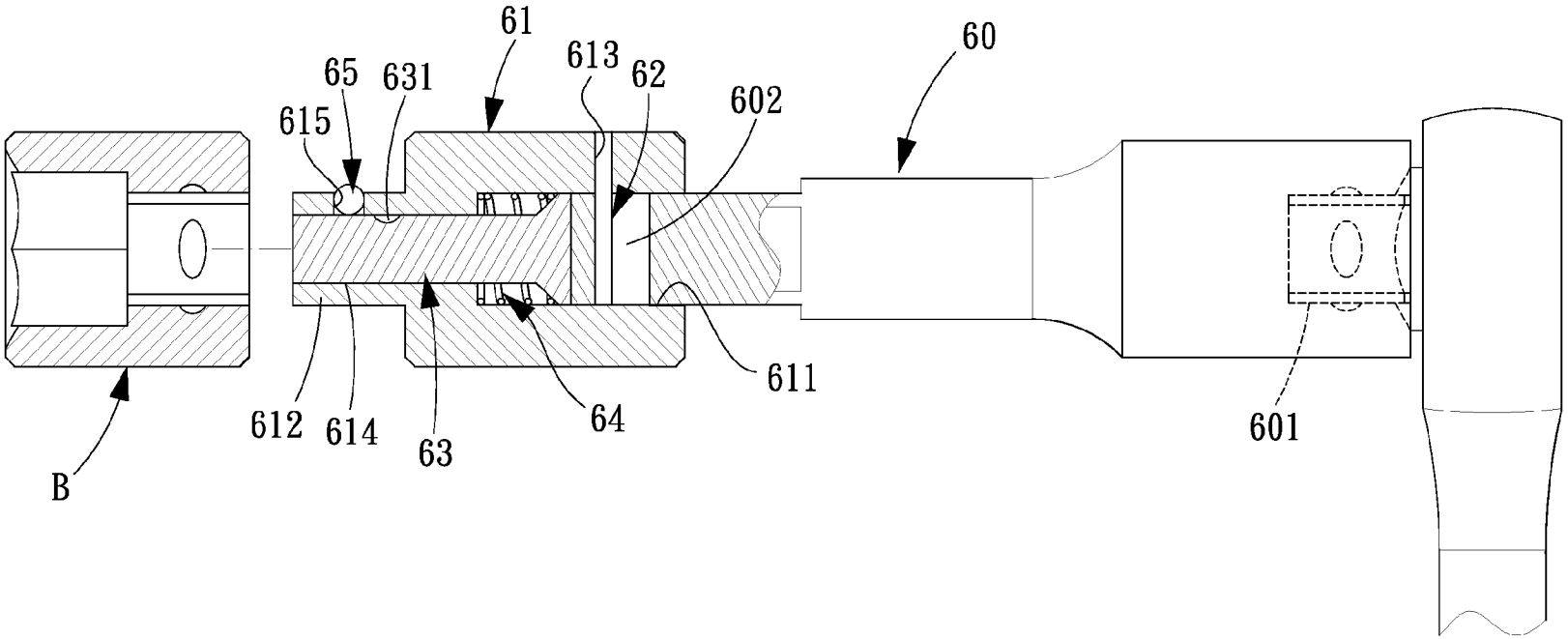
FIG. 7 PRIOR ART
FIG. 7 is a cross-sectional view of the conventional connecting rod.
Figure 8:
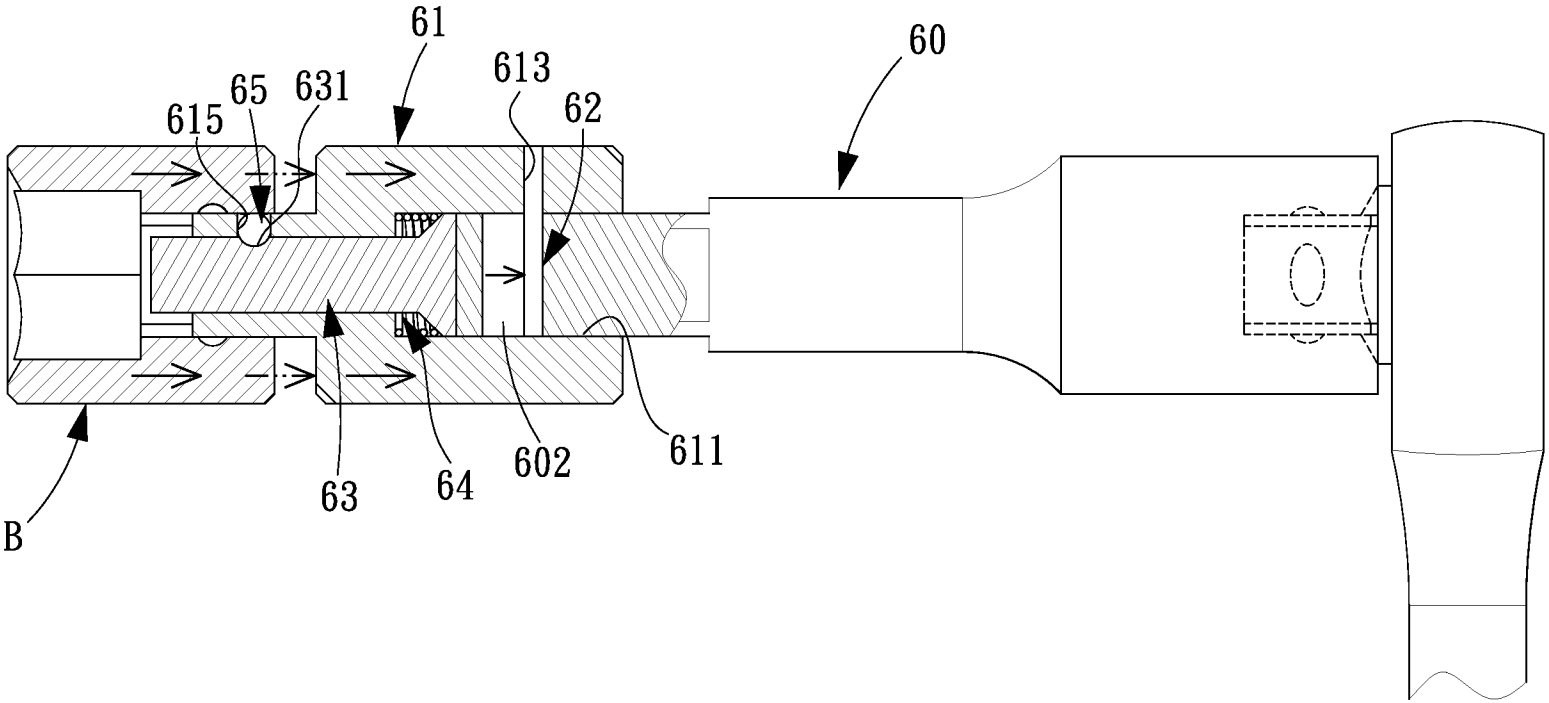
FIG. 8 PRIOR ART
FIG. 8 is a cross-sectional operational view of the conventional connecting rod.

To engage the tool head B on the pivot element 20, referring to FIG. 3 first, the connecting pillar 21 is partially engaged in the combining hole B1, and then when being brought into contact with the engaging element 50 protruding from the connecting pillar 21, the combining hole B1 will apply a push force to the engaging element 50 and the pivot element 20 to make the pivot element 20 move along the connecting rod 30. Meanwhile, the engaging element 50 will move toward the evasion portion 321 from the stopping portion 322 to fall into the evasion portion 321 of the connecting pillar 21, as shown in FIG. 4, allowing the connecting pillar 21 to be fully engaged in the combining hole B1. At the same time, the pivot element 20 will be pushed to move relative to the connecting rod 30 and the connecting element 10 and compress the spring 40 to produce an elastic push force between the pivot element 20 and the connecting element 10. After that, when the connecting pillar 21 is fully engaged in the combining hole B1, and the engaging element 50 is brought into alignment with the engaging groove B2, the engaging element 50 can move toward the engaging groove B2, at this moment, the spring 40 will push the connecting element 10 and the pivot element 20 to cause relative position change of the two. Meanwhile, the pivot element 20 and the connecting rod 30 are moved relative to each other to make the evasion groove 32 move until the engaging element 50 is stopped by the stopping portion 322 of the engaging element 50 to protrude from the surface of the connecting pillar 21 again and aligned with the engaging groove B2 Finally, as shown in FIG. 5, the tool head B is substantially engaged with the pivot element 20 and the connecting element 10 to form an integral drive structure, which is advantageous for the drive tool C to drivingly engage with the second end of the connecting element 10.

With the above structure, the connecting rod assembly in accordance with the present invention has the following advantages:

1. Few components, lower production cost, and quick and convenient to assemble.

2. Since the connecting rod 30 and the connecting element 10 are combined by screwing, the assembly is quick and convenient without extra alignment. Furthermore, after the screwing operation, the compressed spring 40 will be biased between the pivot element 20 and the connecting element to provide an elastic predetermined force to make the whole components form a stable assembled structure, avoiding the impact noise and making the connecting rod assembly easy to operate.

While we have shown and described various embodiments in accordance with the present invention, it is clear to those skilled in the art that further embodiments may be made without departing from the scope of the present invention.

What is claimed is:

1. A connecting rod assembly comprising:

a connecting element provided with a connecting portion at a first end thereof and a driving portion at a second end thereof, the driving portion being a polygonal column, wherein the driving portion of the connecting element is formed with a threaded hole, a connecting rod is formed on a first end thereof with a threaded portion to be screwed into the threaded hole for fixedly connecting the connecting rod and the connecting element;

a pivot element provided at a first end thereof with a connecting pillar formed with a pivot hole, a second end of the pivot element being formed with a driving groove in communication with the pivot hole, the driving groove being structured into a polygonal hole for cooperating with the driving portion of the connecting element, the connecting pillar being formed in an outer surface thereof with a moving hole in communication with the pivot hole, the pivot element being movably engaged onto the driving portion of the connecting element through the driving groove and movable between first and second positions;

the connecting rod having the first end thereof fixedly connected to the connecting element, and a second end of the connecting rod disposed in the pivot hole, the connecting rod being formed in an outer surface thereof with an evasion groove, the evasion groove being interiorly formed with an evasion portion and a stopping portion, with the evasion portion deeper than the stopping portion;

a spring disposed in the driving groove with both ends thereof pushed against an inner surface of the driving groove and the connecting element; and an engaging element in the form of a ball slidably disposed in the moving hole and located between the moving hole and the evasion groove, the spring biasing the pivot element relative to the connecting element, the spring being compressed when the pivot element is in the second position, the ball being stopped in the stopping portion of the evasion groove and partially protruding out of the moving hole of the pivot element when the pivot element is in the first position, the engaging element fallen in the evasion portion of the evasion groove and not projecting out of the moving hole of the pivot element when the pivot element is in the second position.

2. The connecting rod assembly as claimed in claim 1, wherein the connecting rod is connected to a tool head, the tool head is formed in a first end thereof with a combining hole which is polygonal in cross section, the combining hole is formed in an inner surface thereof with at least one engaging groove, a second end of the tool head is provided with a tool portion, the combining hole of the tool head is engaged with the connecting pillar, the engaging element falls into the evasion groove and is brought into alignment with the engaging groove.

3. The connecting rod assembly as claimed in claim 1, wherein the connecting rod is connected to a rotating tool, the rotating tool is provided with a combining portion in the form of a polygonal column, the connecting portion of the connecting element is a polygonal column and engaged on the combining portion of the rotating tool to connect the connecting rod assembly and the rotating tool together.

4. The connecting rod assembly as claimed in claim 1, wherein the evasion groove includes the evasion portion located adjacent to the first end of the connecting rod and the stopping portion located adjacent to the second end of the connecting rod.

5. The connecting rod assembly as claimed in claim 1, wherein the engaging element is slidable toward the pivot hole and adapted to partially protrude from a surface of the connecting pillar without disengagement from the moving hole.

* * * * *